US009784268B2

(12) United States Patent
Rabhi

(10) Patent No.: US 9,784,268 B2
(45) Date of Patent: Oct. 10, 2017

(54) SEALING RING FOR HYDRAULIC PUMP DISTRIBUTOR

(71) Applicant: Vianney Rabhi, Lyons (FR)

(72) Inventor: Vianney Rabhi, Lyons (FR)

( * ) Notice: Subject to any disclaimer, the term of this patent is extended or adjusted under 35 U.S.C. 154(b) by 398 days.

(21) Appl. No.: 14/491,077

(22) Filed: Sep. 19, 2014

(65) Prior Publication Data

US 2015/0086399 A1 Mar. 26, 2015

Related U.S. Application Data

(60) Provisional application No. 61/882,279, filed on Sep. 25, 2013.

(51) Int. Cl.
*F04B 53/14* (2006.01)

(52) U.S. Cl.
CPC ..... *F04B 53/143* (2013.01)

(58) Field of Classification Search
CPC .. F04B 1/122; F04B 53/143; F16J 1/12; F16J 7/00
See application file for complete search history.

(56) References Cited

U.S. PATENT DOCUMENTS 5,058,485 A * 10/1991 Cardillo ..... F04B 1/2042 417/269
5,385,451 A * 1/1995 Fujii ..... F04B 27/1018 417/269
5,655,430 A * 8/1997 Richards ..... F01B 13/04 417/269
6,773,226 B2 * 8/2004 Al-Hawaj ..... B01D 61/06 415/116
2009/0024172 A1 * 1/2009 Pizzicara ..... A61B 17/8057 606/280
2009/0068027 A1 * 3/2009 Uchikado ..... F04B 27/1045 417/269

* cited by examiner

*Primary Examiner* — Patrick Hamo
(74) *Attorney, Agent, or Firm* — Young & Thompson

(57) ABSTRACT

A hydraulic pump distributor sealing ring for a hydraulic distributor of a hydraulic pump, includes a continuous sealing ring housed in a ring groove formed in a pump stator whose inlet-delivery ports are each aligned with a distribution opening passing right through the ring in the direction of its thickness, this ring including a circumferential-contact boss which has a circumferential line of contact that can come into contact with a rotor-side low-pressure sealing surface, the ring also including a compression-decompression track, a ring sealing lip that provides sealing between the ring and the ring groove, and rotation-proofing elements.

26 Claims, 11 Drawing Sheets

FIG.4

SEALING RING FOR HYDRAULIC PUMP DISTRIBUTOR

BACKGROUND OF THE INVENTION

Field of the Invention

The subject of the present invention is a sealing ring for a hydraulic pump distributor.

Description of the Related Art

Rotary cylinder axial-piston or radial-piston hydraulic pumps, particularly those of variable cylinder capacity, are usually made up of a rotor in which hydraulic cylinders are formed. Within each of the said cylinders, a hydraulic piston performs reciprocating movements.

The said rotor ordinarily comprises a feed face kept in the most sealed possible contact with a distribution face—also sometimes known as a distribution plate—formed at the surface of a stator, it being possible for the latter to form part of a pump body.

The feed face generally comprises orifices each connected to one of the hydraulic cylinders, whereas the distribution face comprises at least one inlet port via which the hydraulic pistons can draw in a hydraulic fluid and at least one delivery port via which the said pistons can deliver the said fluid, the said orifices and the said ports constituting a hydraulic distributor.

Thus, as the rotor turns, the said orifices are alternately brought into communication with an inlet duct by the inlet port then with a delivery duct via the delivery port. The result of this is that a flow of hydraulic fluid may become established between the said ducts as a result of the reciprocating movements that the hydraulic pistons perform, each one in its own hydraulic cylinder.

It will be noted that leaks of hydraulic fluid unavoidably occur between the feed face and the distribution face. As a result, some of the hydraulic fluid passes directly from the delivery duct to the inlet duct or vice versa, on the one hand, while some of the said fluid passes directly from the said ducts to an internal housing that the said hydraulic pumps generally comprise, on the other hand. These leaks reduce the volumetric and energy efficiency of the said pumps.

In the case of hydraulic pumps of the type having axial pistons, in order to be as sealed as possible with respect to one another, the feed face and the distribution face are subjected to a load which tends to keep them in contact with one another. This load is notably the result of the reaction force generated by a thrust plate in response to the thrust of the hydraulic pistons, it being possible for example for the said plate to be a swashplate or a yoke.

Combined with the relative movement of the said faces, the said reaction force results in friction losses which reduce the energy efficiency of the pumps designed in this way. It must be pointed out that, in the particular case of axial-piston hydraulic pumps, the feed face and the distribution face are each positioned on a planar circular surface.

In the case of rotary cylinder radial-piston hydraulic pumps, the distributor is usually made up of a distribution face positioned on the external surface of a first cylinder secured to the stator, whereas the feed face is positioned on the internal surface of a second cylinder which fits over the first cylinder and is secured to the rotor. With this particular configuration, sealing between the said faces is preferably obtained by a small clearance left between the first and second cylinders, extreme precision being required in the machining of these cylinders during manufacture.

Obtaining sealing using this strategy leads to significant leaks that occur at this latter type of distributor, even though the friction losses generated by the said distributor are potentially lower. Furthermore, unless the radial-piston hydraulic pump is radially balanced with at least two inlet ports and two delivery ports which are diametrically opposed, the pressure exerted by the hydraulic fluid on the cross section of the port subjected to the higher pressure may subject the said distributor to what can be a potentially high radial load that may cause not-insignificant additional friction losses.

This disadvantage can be lessened if not practically eliminated if radial-load equalizing grooves are provided to counterbalance the radial load of the inlet or delivery port that is subjected to the higher pressure. Such an arrangement is, for example, set out in the patent application relating to a pump motor U.S. Pat. No. 1,354,562 dated May 22, 2013, in the name of the applicant.

Bearing in mind the foregoing, in the current state of the art, a distributor with a high level of sealing tends to generate high friction losses whereas, conversely, a distributor with low friction losses is rather inclined to exhibit significant leaks of hydraulic fluid.

It may be noted that the relative drop in energy efficiency caused by the hydraulic leaks and by the friction losses occurring between the feed face and the distribution face of rotary cylinder radial-piston or axial-piston hydraulic pumps, notably those of variable cylinder capacity, is higher if the pressure at which the said pumps operate is higher, on the one hand, and if the said pumps are used at partial cylinder capacity, on the other hand.

It is therefore particularly important to reduce the said leaks and the said losses as far as possible while at the same time recovering the highest possible fraction of the energy released by the hydraulic fluid as it decompresses.

SUMMARY OF THE INVENTION

It is in order to meet this set of objectives that the sealing ring for a hydraulic pump distributor according to the invention makes the following provisions, in relation to the prior art and when, according to one particular embodiment, it equips a distributor with cylindrical feed and distribution faces:

- For the same friction losses, the leakage flows that occur at the said distributor between the inlet ducts and the delivery ducts are reduced, as are the leakage flows that occur between the said ducts and the internal housing that hydraulic pumps generally comprise;
- For the same level of sealing, the friction losses generated by the said distributor are lower.

As a result, the sealing ring for a hydraulic pump distributor according to the invention is notably able:

- To contribute to the creation of hydraulic pumps exhibiting high volumetric and energy efficiency;
- To allow the design and manufacture of hydraulic pumps or hydraulic motor-pumps that may beneficially constitute, together with other components, a hydraulic hybrid transmission of high energy efficiency intended for motor vehicle propulsion.

Furthermore, the sealing ring for a hydraulic pump distributor according to the invention has a low cost price, its manufacture calling for no complex method or costly material.

The said ring is also designed to offer a high degree of robustness and longevity and may be used in the field of high hydraulic pressures.

The said ring can also be applied to any hydraulic pump or hydraulic pump-motor of fixed or variable cylinder capacity, notably whether the pump or pump-motor be of the vane, axial piston, radial piston, rotary or nonrotary cylinder type, and regardless of the fluid on which it runs: liquid, gaseous or semi-liquid.

The sealing ring for a hydraulic pump distributor designed for a hydraulic distributor that a hydraulic pump may comprise, the said distributor comprising at least one pump stator distribution face secured to a pump stator, the said distribution face having a stator-side low-pressure sealing surface from which there open at least two inlet-delivery ports formed in the pump stator and each of which communicates with at least one inlet-delivery duct specific to it and likewise formed inside the said stator, the said distributor also comprising at least one pump rotor feed face secured to a pump rotor, the said feed face having a rotor-side low-pressure sealing surface from which there opens at least one orifice communicating with a feed duct formed inside the said rotor whereas the stator-side low-pressure sealing surface is positioned facing the rotor-side low-pressure sealing surface so that the feed orifice alternately finds itself facing one or other of the two inlet-delivery ports at least once per revolution of the pump rotor, comprises:

At least one continuous sealing ring housed with a small amount of axial and/or radial clearance in a ring groove formed in the pump stator inside the surface area delimited by the stator-side low-pressure sealing surface, the said ring having a stator-side ring face housed inside the ring groove, and a rotor-side ring face flush with the stator-side low-pressure sealing surface, whereas the inlet-delivery ports open onto the said sealing surface via the said groove, the said ring being axially or radially wider than the said ports so as to cover them and comprising, approximately in axial or radial alignment therewith, at least one distribution opening passing right through the continuous sealing ring in the direction of its thickness, the said opening being able to place one of the two inlet-delivery ports in communication with the feed orifice when the latter is approximately facing the said port;

At least one circumferential-contact boss formed axially or radially on each side of the distribution opening, the said boss having a circumferential line of contact that can come into contact with the rotor-side low-pressure sealing surface;

At least one compression-decompression track formed on a certain angular sector of the rotor-side ring face, the said sector being positioned outside of that part of the said face in which the radial distribution opening is situated;

At least one ring sealing lip that may or may not be secured to the continuous sealing ring and that performs axial or radial sealing between the said ring and the ring groove;

At least one compression-decompression sealing gasket which performs sealing between the stator-side ring face and the bottom and/or the axial or radial sides of the ring groove and does so in the angular area defined by the angular sector over which the compression-decompression track is formed;

Rotation-proofing means which keep the continuous sealing ring in a fixed angular position in relation to the pump stator.

The sealing ring for a hydraulic pump distributor according to the present invention comprises a ring groove which comprises a ring bearing face on its sides which are oriented at right angles to the stator-side low-pressure sealing surface, the said bearing face collaborating with a ring bearing shoulder that the continuous sealing ring comprises.

The sealing ring for a hydraulic pump distributor according to the present invention comprises a ring groove which comprises a ring sealing face on its sides which are oriented at right angles to the stator-side low-pressure sealing surface, the said sealing face collaborating with a ring sealing shoulder that the continuous sealing ring comprises.

The sealing ring for a hydraulic pump distributor according to the present invention comprises a ring sealing lip which is a flexible metal blade secured to the ring sealing shoulder.

The sealing ring for a hydraulic pump distributor according to the present invention comprises a ring sealing lip which is positioned on, under or in the continuation of the ring sealing shoulder.

The sealing ring for a hydraulic pump distributor according to the present invention comprises a ring sealing lip which consists of a lateral sealing gasket made of a flexible material kept simultaneously in contact with the ring groove and with the stator-side ring face.

The sealing ring for a hydraulic pump distributor according to the present invention comprises a compression-decompression sealing gasket which has at least one sectorial compression-decompression cell cavity which, with the stator-side ring face and the bottom and/or axial or radial sides of the ring groove, defines a closed and sealed volume.

The sealing ring for a hydraulic pump distributor according to the present invention comprises a compression-decompression sealing gasket which comprises a stiffening cellular structure in which the sectorial compression-decompression cell cavity is formed, the said cellular structure being produced in a rigid material and being able to be kept in position in relation to the continuous sealing ring directly or indirectly using the rotation-proofing means, whereas the said rigid material may be coated completely or partially with a flexible material that can come into contact with the stator-side ring face on the one hand, and/or with the bottom and/or the axial or radial sides of the ring groove on the other hand.

The sealing ring for a hydraulic pump distributor according to the present invention comprises a stiffening cellular structure which is incorporated into the stator-side ring face and which is made from the same piece of material as the continuous sealing ring.

The sealing ring for a hydraulic pump distributor according to the present invention comprises a compression-decompression track which has at least one sectorial compression-decompression orifice via which a sectorial compression-decompression duct opens, the latter duct connecting the closed and sealed volume defined by the sectorial compression-decompression cell cavity with the rotor-side ring face, the said sectorial orifice being positioned in such a way that the feed orifice finds itself facing the said sectorial orifice once per revolution of the pump rotor, the said sectorial orifice then connecting the feed duct to the said sealed volume via the sectorial compression-decompression duct.

The sealing ring for a hydraulic pump distributor according to the present invention comprises a lateral sealing gasket and a compression-decompression sealing gasket which form just one single component.

The sealing ring for a hydraulic pump distributor according to the present invention comprises a ring sealing face which is positioned approximately plumb with the circumferential line of contact.

The sealing ring for a hydraulic pump distributor according to the present invention comprises a ring sealing face which is positioned approximately plumb with the circumferential line of contact whereas the ring sealing face is further away from the bottom of the ring groove and the distribution opening than the said sealing face so that it is offset out of plumb with the circumferential line of contact.

The sealing ring for a hydraulic pump distributor according to the present invention comprises at least one of the axial faces of the ring groove which is formed by the axial face of a ring mounting band that fits closely around the pump stator.

The sealing ring for a hydraulic pump distributor according to the present invention comprises a pump stator distribution face and a pump rotor feed face which are cylindrical whereas at least one of the inlet-delivery ports collaborates with at least one radial load-compensating port formed in the pump stator, the latter port opening from the pump stator distribution face and facing the pump rotor feed face, the said compensating port also being situated—within the said stator—diametrically opposite the inlet-delivery port with which it collaborates and being connected by a radial-load compensating duct to the inlet-delivery duct to which the said inlet-delivery port with which it collaborates is connected.

The sealing ring for a hydraulic pump distributor according to the present invention comprises a compensating port which opens from the pump stator distribution face via a radial-load compensating groove in which a radial-load compensating sealing plate is housed with a small amount of axial and/or tangential clearance.

The sealing ring for a hydraulic pump distributor according to the present invention comprises a radial-load compensating sealing plate which has passing right through it in the direction of its thickness a compensating opening which places the radial-load compensating duct in communication with the pump rotor feed face.

The sealing ring for a hydraulic pump distributor according to the present invention comprises a radial-load compensating groove which comprises a plate bearing face on its sides which are oriented at right angles to the stator-side low-pressure sealing surface, the said bearing face collaborating with a plate bearing shoulder that the radial-load compensating sealing plate comprises.

The sealing ring for a hydraulic pump distributor according to the present invention comprises a radial-load compensating groove which comprises a plate sealing face on its sides which are oriented at right angles to the stator-side low-pressure sealing surface, the said sealing face collaborating with a plate sealing shoulder that the radial-load compensating sealing plate comprises.

The sealing ring for a hydraulic pump distributor according to the present invention comprises a radial-load compensating sealing plate which collaborates with a compensating-plate sealing lip that may or may not be secured to the said plate, the said lip performing axial and/or radial and/or tangential sealing between the said plate and the radial-load compensating groove.

The sealing ring for a hydraulic pump distributor according to the present invention comprises a ring sealing lip which consists of a flexible compensating sealing gasket made of a flexible material kept simultaneously in contact with the radial-load compensating groove and with the radial-load compensating sealing plate.

The sealing ring for a hydraulic pump distributor according to the present invention comprises a radial-load compensating sealing plate which comprises at least one compensating peripheral contact boss formed at its periphery, the said boss having a compensating peripheral line of contact able to come into contact with the pump rotor feed face.

The sealing ring for a hydraulic pump distributor according to the present invention comprises a plate sealing face which is positioned approximately plumb with the compensating peripheral line of contact.

The sealing ring for a hydraulic pump distributor according to the present invention comprises a plate sealing face which is positioned approximately plumb with the compensating peripheral line of contact whereas the plate bearing face is further away from the bottom of the radial-load compensating groove and the compensating opening than the said sealing face so that it is offset out of plumb with the compensating peripheral line of contact.

The sealing ring for a hydraulic pump distributor according to the present invention comprises a distribution opening which comprises at least one connecting beam which connects together the circumferential-contact bosses, the said beam thus defining on either side of its length at least one distribution sub-opening.

The sealing ring for a hydraulic pump distributor according to the present invention comprises rotation-proofing means which consist of at least one ring rotation-proofing pin which on the one hand is plugged into a stator rotation-proofing pin hole formed in the pump stator and on the other hand is inserted into a ring rotation-proofing pin hole that passes through the continuous sealing ring in the direction of its thickness.

BRIEF DESCRIPTION OF THE DRAWING FIGURES

The description which will follow with reference to the attached drawings, which are given by way of nonlimiting examples, will permit a better understanding of the invention, of the features that it exhibits and of the advantages it is capable of affording:

Figure 3:
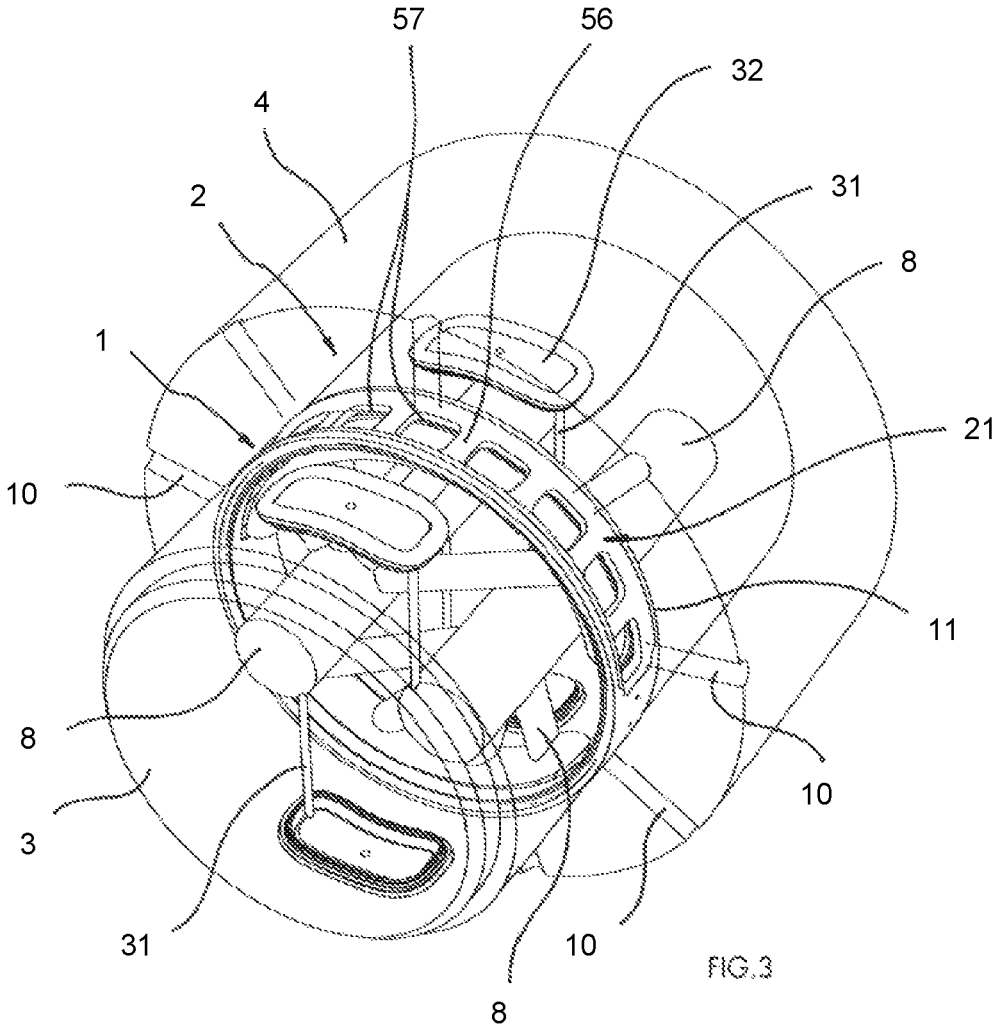
Figure 4:
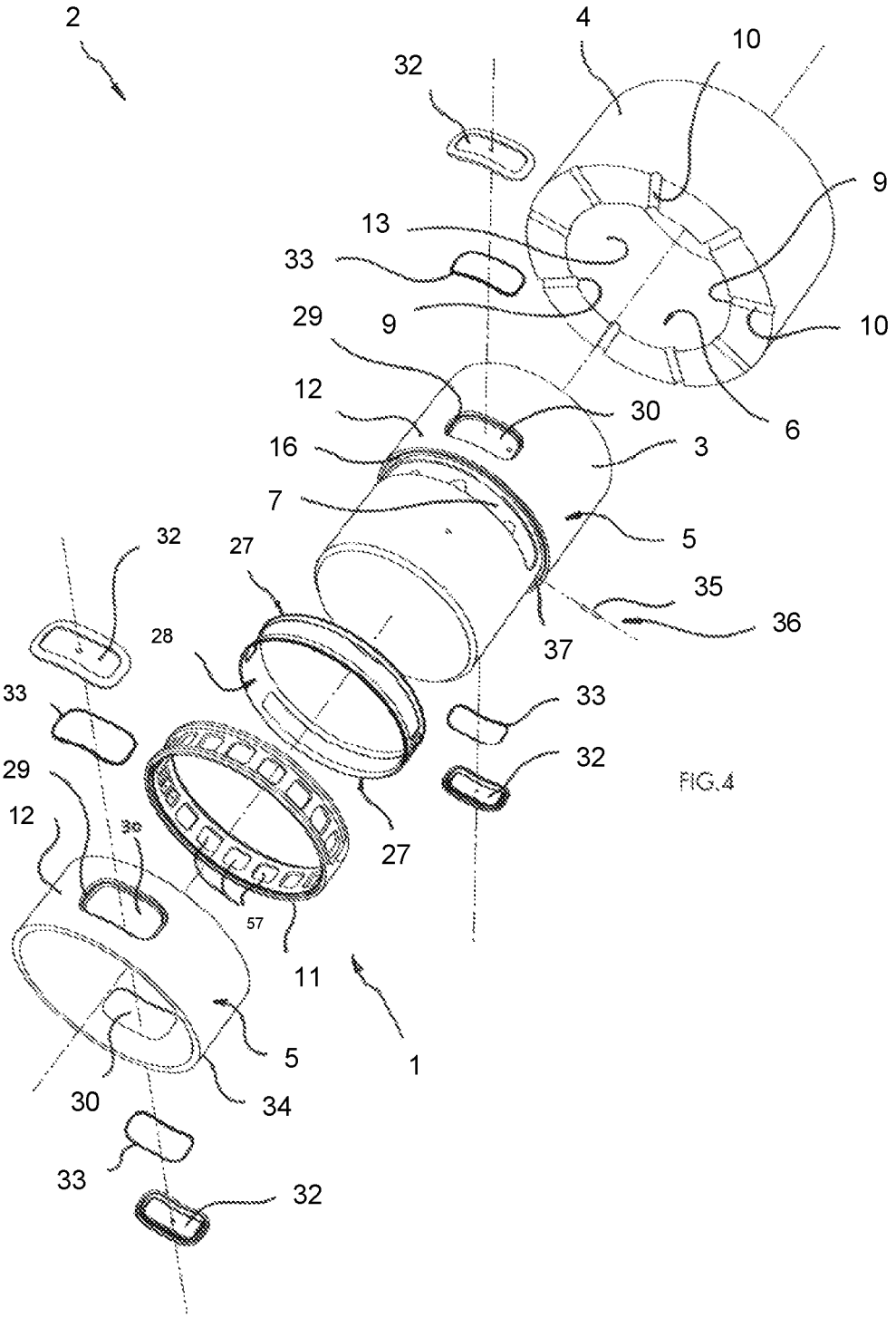

FIGS. 3 and 4 are, respectively, a three-dimensional phantom view and an exploded three-dimensional view of a hydraulic distributor that accepts the hydraulic pump distributor sealing ring according to the invention the continuous sealing ring of which is of cylindrical overall shape, the said ring collaborating with four radial-load compensating ports positioned axially on each side of two inlet-delivery ports.

Figure 5:
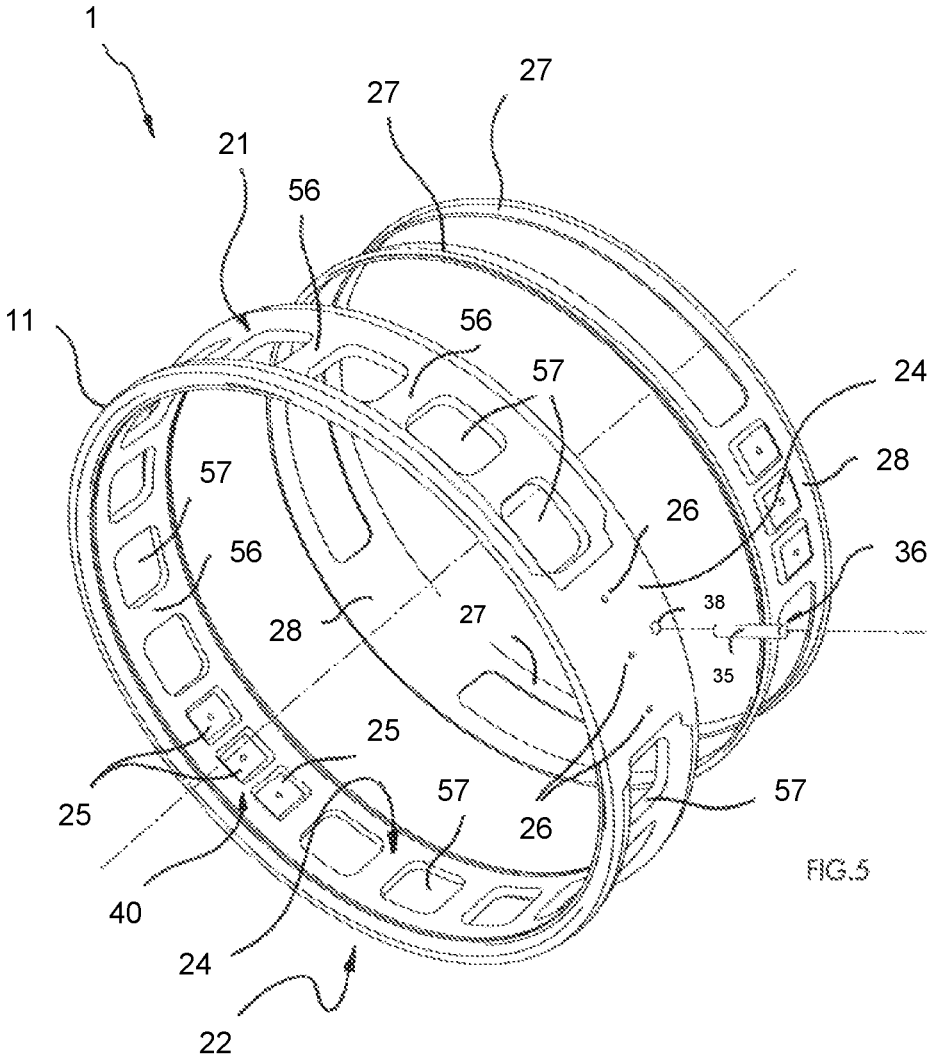

FIG. 5 is a three-dimensional view of the continuous sealing ring when it is of cylindrical overall shape, and of two compression-decompression sealing gaskets and of four lateral sealing gaskets which are made up of the same continuous piece of flexible material with which the said ring can collaborate, it being possible for this configuration to form one particular embodiment of the hydraulic pump distributor sealing ring according to the invention.

Figure 6:
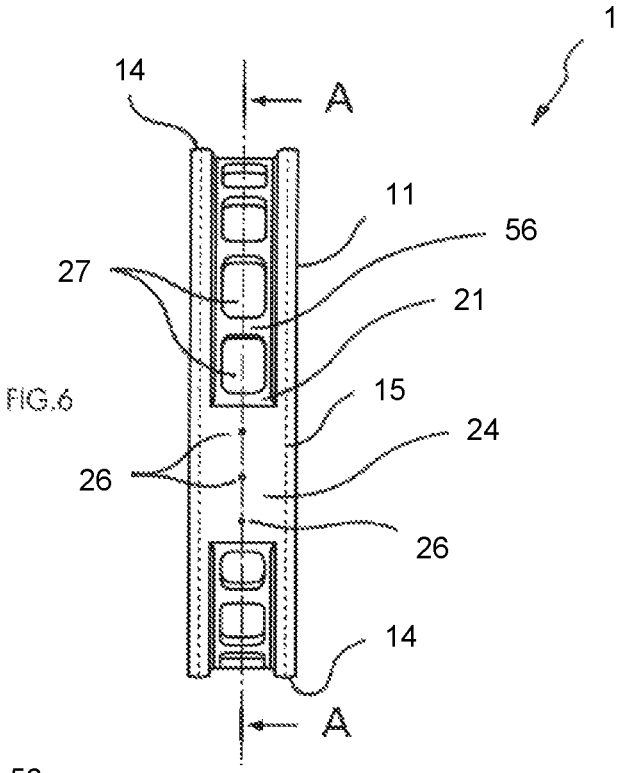
Figure 7:
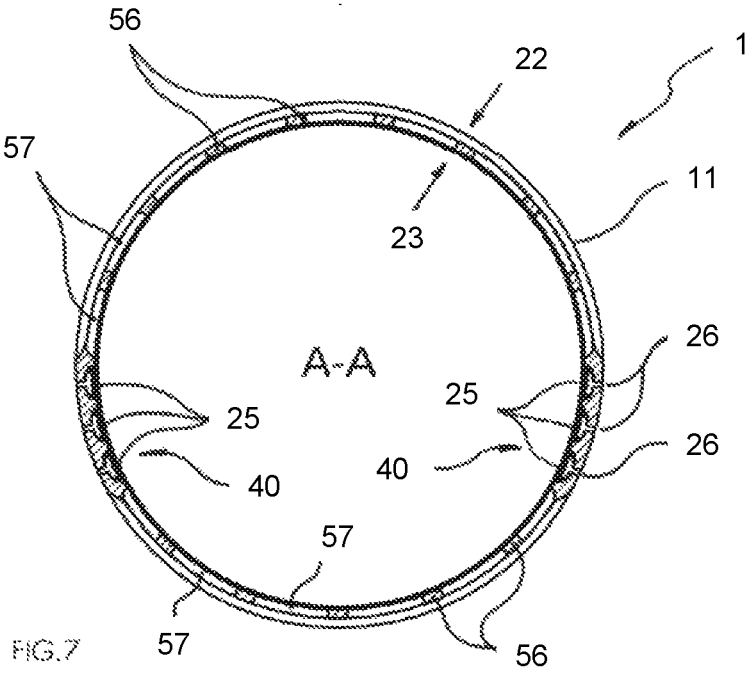

FIGS. 6 and 7 are, respectively, a side view and a schematic cross section of the continuous sealing ring when it is of cylindrical overall shape and when it comprises—according to one particular embodiment of the hydraulic pump distributor sealing ring according to the invention—six sectorial compression-decompression cell cavities and 15 distribution sub-openings.

Figure 8:
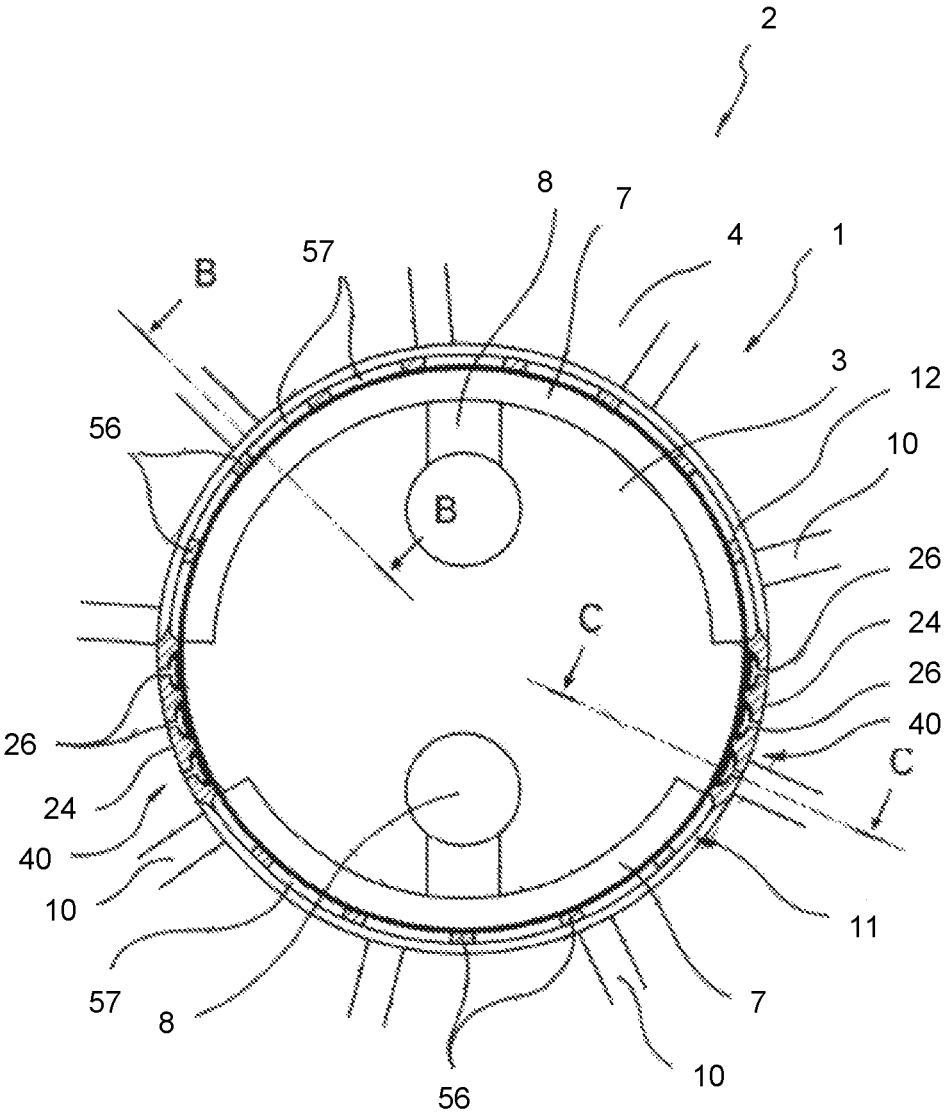

FIG. 8 is a schematic cross section of a hydraulic distributor that accepts the hydraulic pump distributor sealing ring according to the invention, the said distributor comprising a pump stator provided with two inlet-delivery ports which stator collaborates with a pump rotor that has nine feed orifices.

Figure 9:
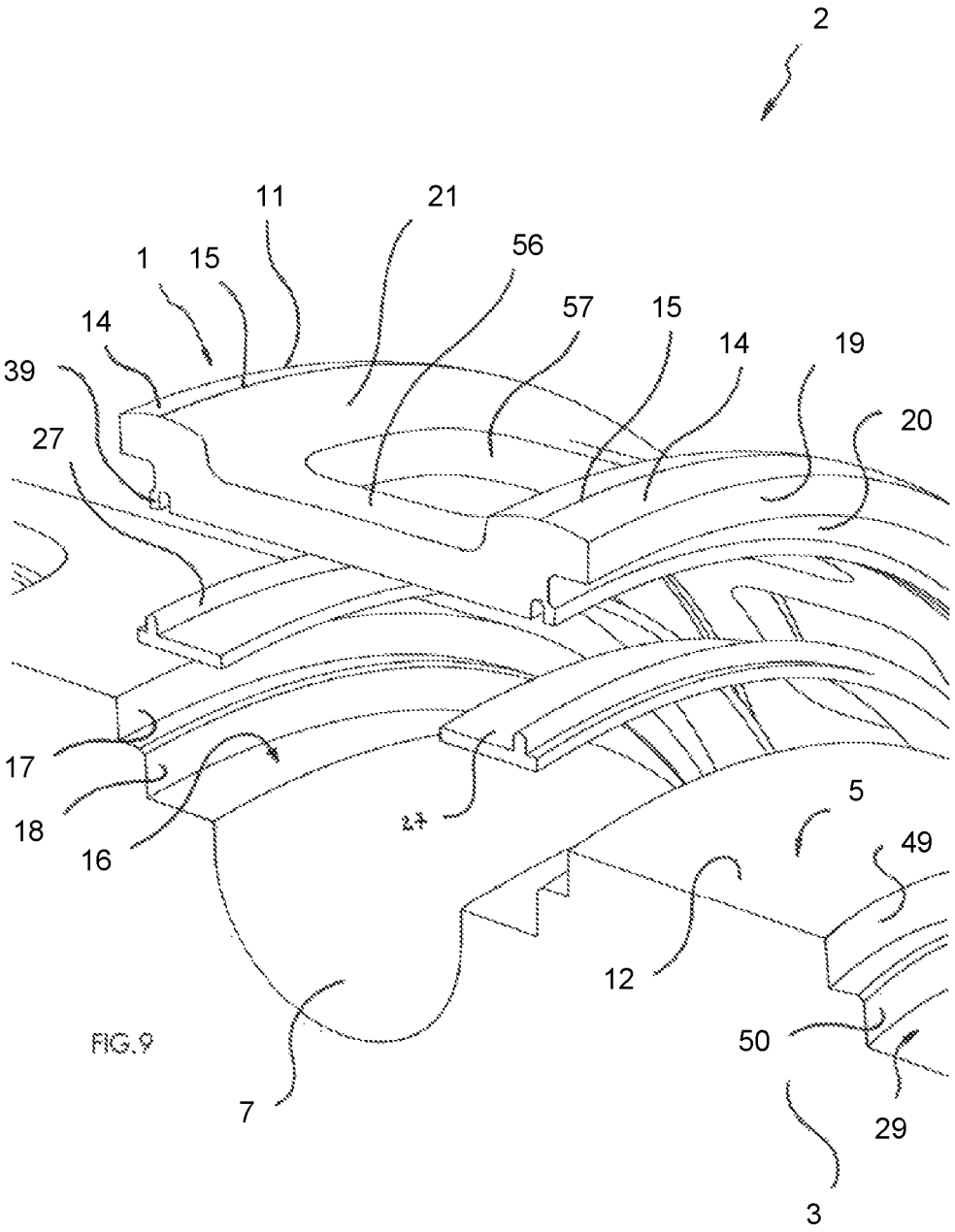

FIG. 9 is a three-dimensional cross section of the continuous sealing ring of the hydraulic pump distributor sealing ring according to the invention and of the lateral sealing gaskets, the ring groove and the pump stator with all of which the said continuous ring collaborates.

Figure 10:
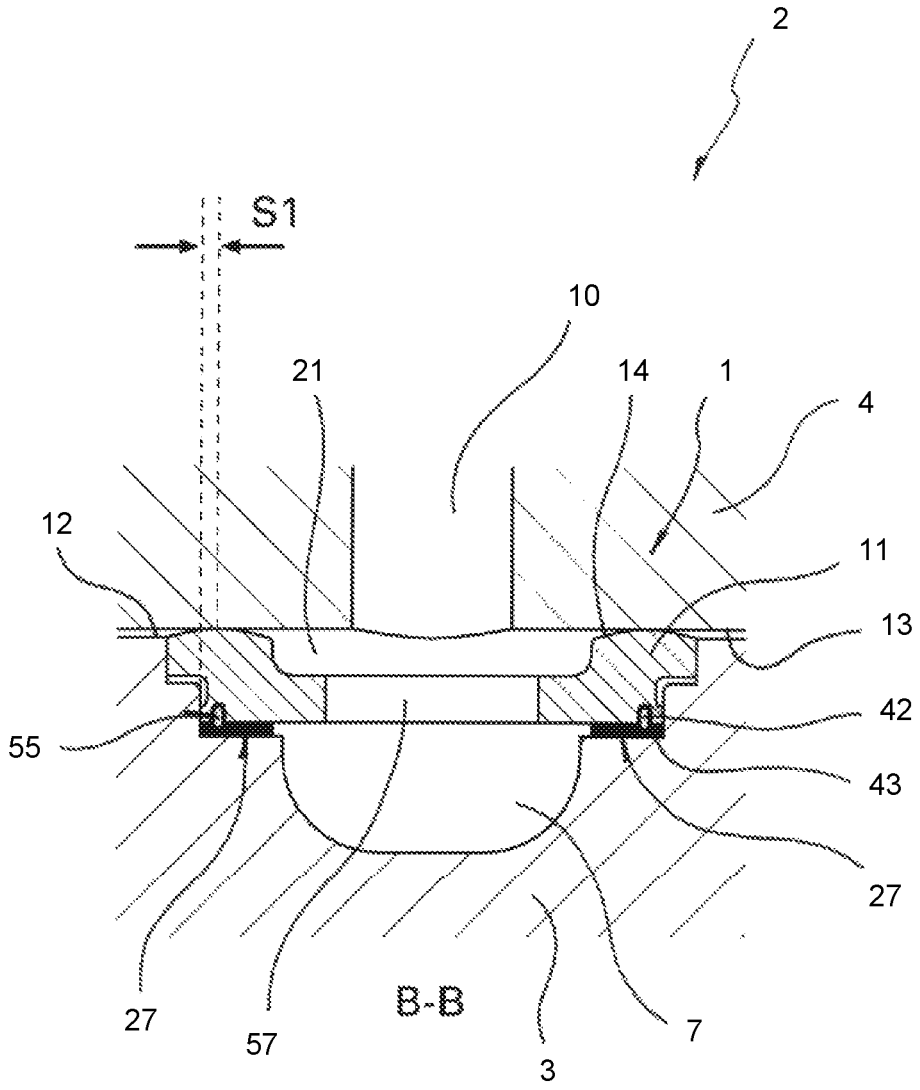

FIG. 10 is a partial schematic section on B-B of the continuous sealing ring shown in FIG. 8 as may be provided for by the hydraulic pump distributor sealing ring according to the invention, the said section being taken in the region of a distribution sub-opening.

Figure 11:
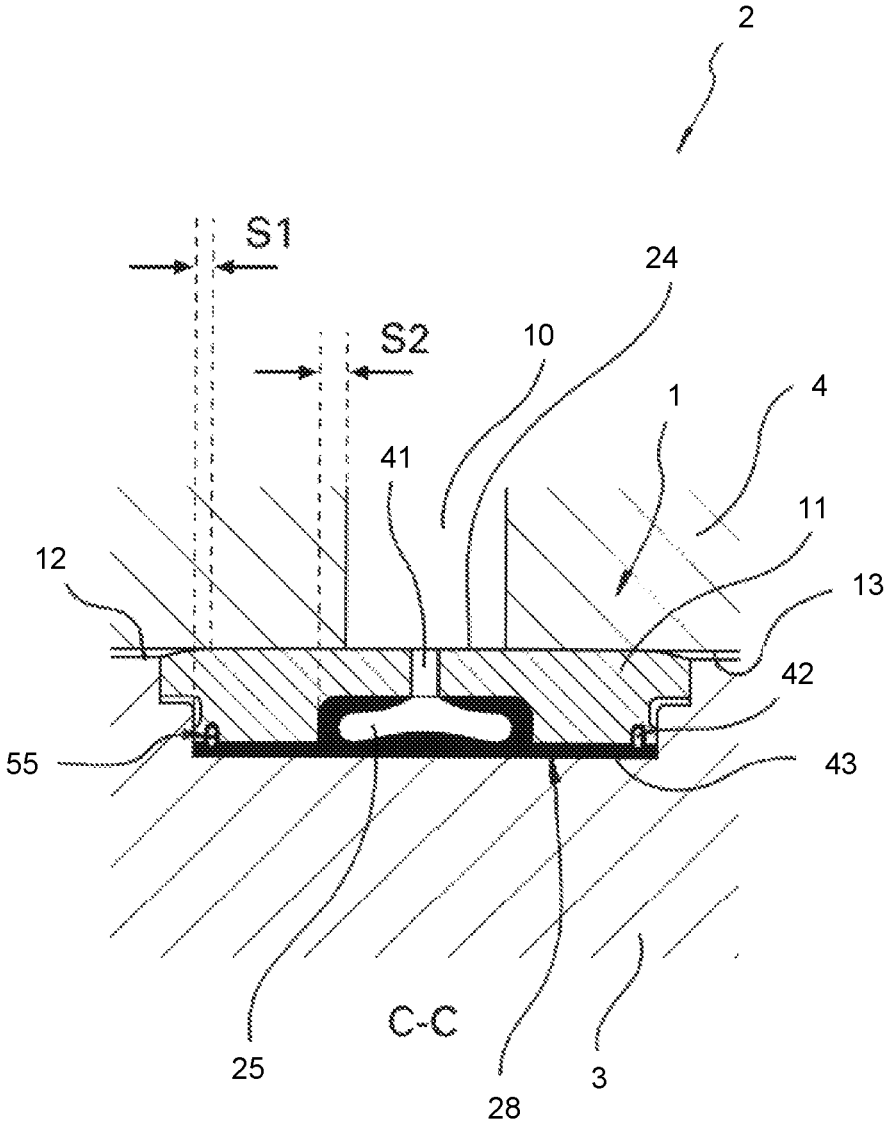

FIG. 11 is a partial schematic cross section on C-C of the continuous sealing ring shown in FIG. 8 as may be provided for by the hydraulic pump distributor sealing ring according to the invention, the said section notably showing how a sectorial compression-decompression cell cavity may be arranged and how this cell cavity can be connected to the surface of the compression-decompression track by a sectorial compression-decompression duct.

Figure 12:
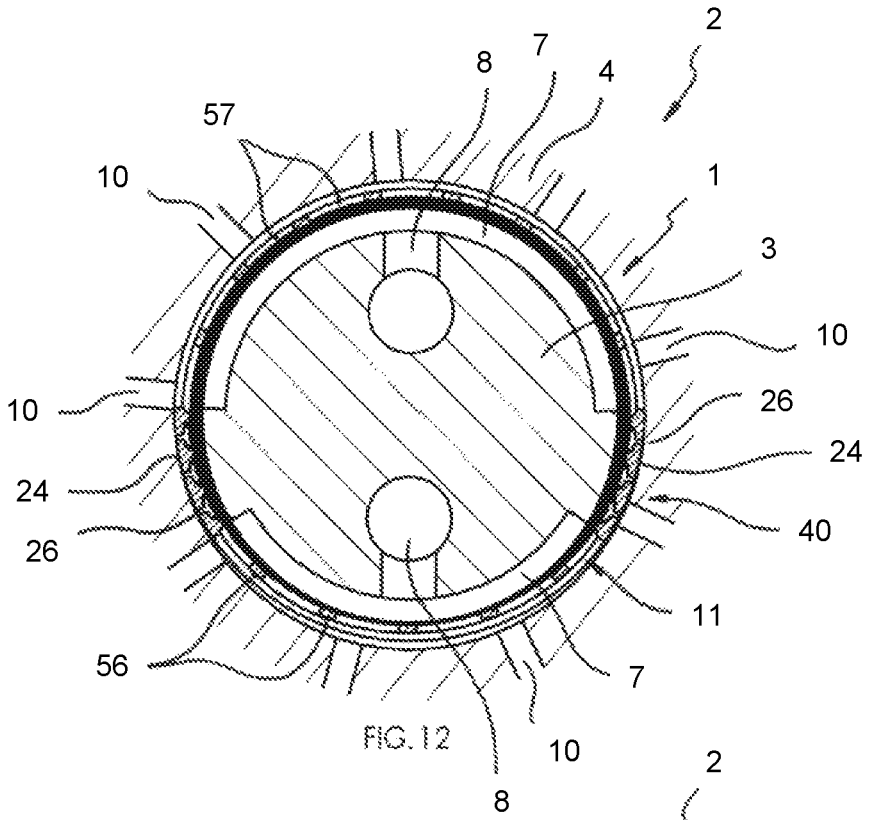
Figure 13:
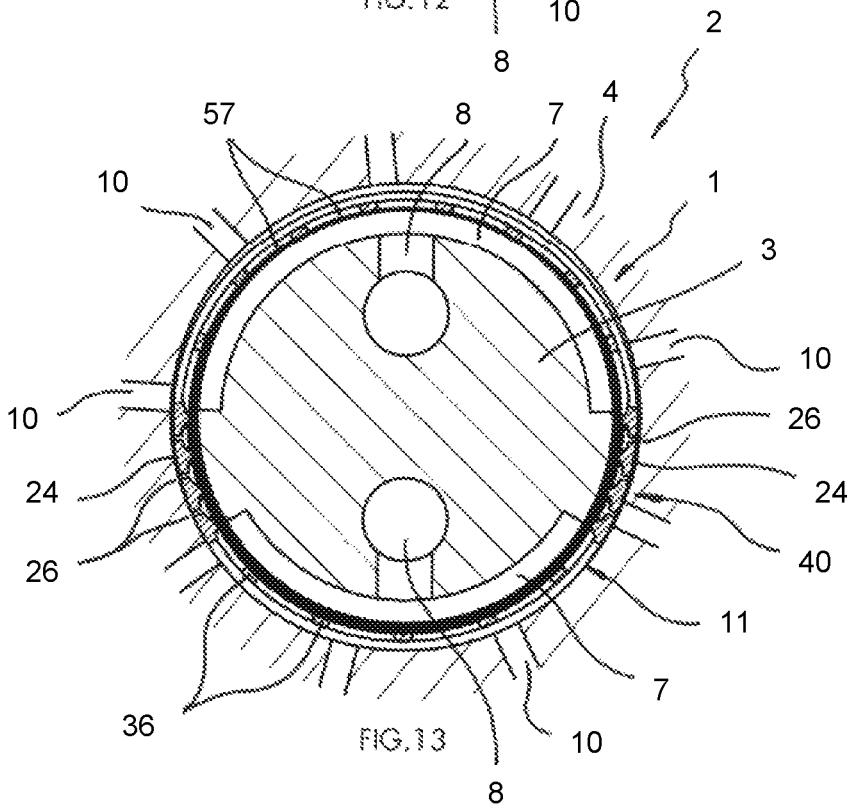

FIGS. 12 and 13 illustrate in schematic cross section how the continuous sealing ring as may be provided for by the hydraulic pump distributor sealing ring according to the invention works when one of the two inlet-delivery ports of the pump stator with which the said continuous ring collaborates is subjected to a high pressure.

Figure 14:
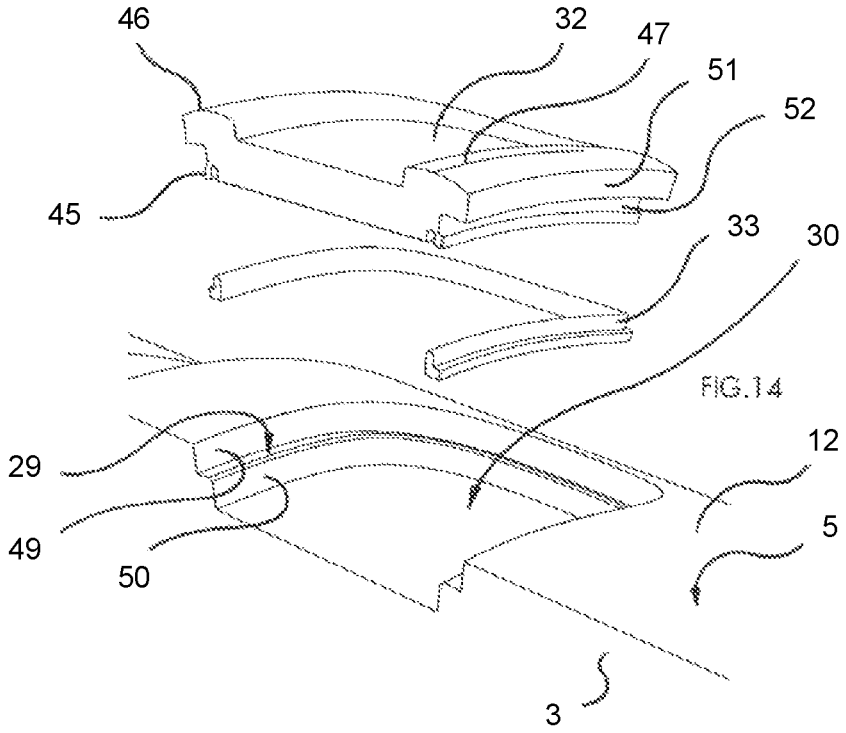

FIG. 14 is a three-dimensional cross section of the radial-load compensating sealing plate that the hydraulic pump distributor sealing ring according to the invention may comprise, and of the flexible compensating sealing gasket, the radial-load compensating groove and the pump stator with all of which the said plate collaborates.

Figure 15:
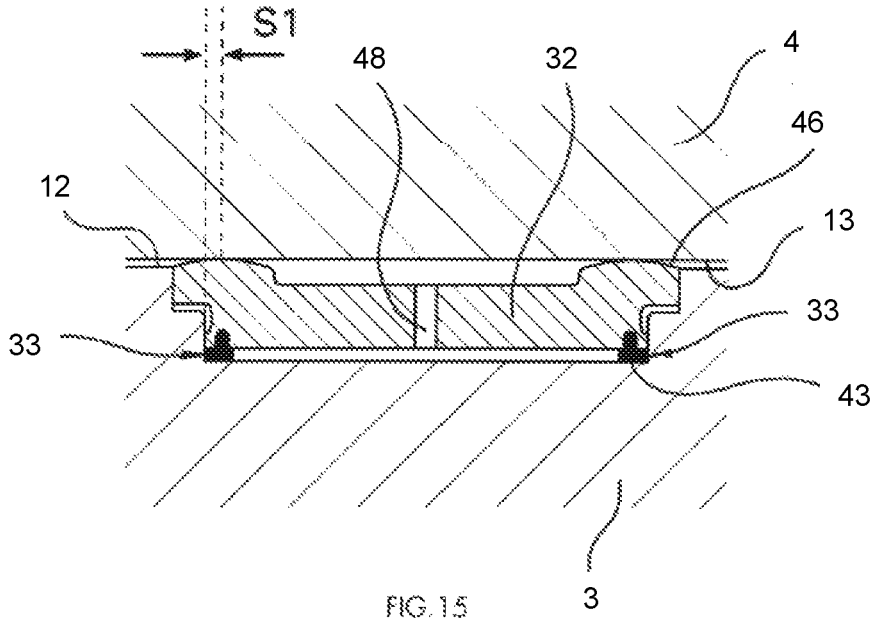

FIG. 15 is a schematic cross section of the radial-load compensating sealing plate as may be provided for by the hydraulic pump distributor sealing ring according to the invention, the said cross section being taken in the region of the compensating opening that the said plate comprises.

DESCRIPTION OF THE INVENTION

FIGS. 1 to 15 show the hydraulic pump distributor sealing ring 1.

The hydraulic pump distributor sealing ring 1 according to the invention is intended for a hydraulic distributor 2 that a hydraulic pump 44 may comprise, the said distributor 2 comprising at least one pump stator distribution face 5 secured to a pump stator 3, the said distribution face 5 having a stator-side low-pressure sealing surface 12 from which there open at least two inlet-delivery ports 7 formed in the pump stator 3 and each of which communicates with at least one inlet-delivery duct 8 specific to it and likewise formed inside the said stator 3, the said distributor 2 also comprising at least one pump rotor feed face 6 secured to a pump rotor 4, the said feed face 6 having a rotor-side low-pressure sealing surface 13 from which there opens at least one orifice 9 communicating with a feed duct 10 formed inside the said rotor 4 whereas the stator-side low-pressure sealing surface 12 is positioned facing the rotor-side low-pressure sealing surface 13 so that the feed orifice 9 alternately finds itself facing one or other of the two inlet-delivery ports 7 at least once per revolution of the pump rotor 4.

FIGS. 1 to 13 show that the hydraulic pump distributor sealing ring 1 comprises at least one continuous sealing ring 11 housed with a small amount of axial and/or radial clearance in a ring groove 16 formed in the pump stator 3 inside the surface area delimited by the stator-side low-pressure sealing surface 12, the said ring 11 having a stator-side ring face 23 housed inside the ring groove 16, and a rotor-side ring face 22 flush with the stator-side low-pressure sealing surface 12, whereas the inlet-delivery ports 7 open onto the said sealing surface 12 via the said groove 16, the said ring 11 being axially or radially wider than the said ports 7 so as to cover them and comprising, approximately in axial or radial alignment therewith, at least one distribution opening 21 passing right through the continuous sealing ring 11 in the direction of its thickness, the said opening 21 being able to place one of the two inlet-delivery ports 7 in communication with the feed orifice 9 when the latter is approximately facing the said port 7, one same distribution opening 21 being capable of placing only one port in communication with the said orifice 9.

It will be noted that the continuous sealing ring 11 may advantageously have a small thickness and a small stiffness so that it can be easily deformed and adapt to its geometric environment even when the hydraulic pressure produced by the hydraulic pump 44 is relatively low.

Thus, as illustrated by FIGS. 9 and 10 in particular, the hydraulic pump distributor sealing ring 1 according to the invention comprises at least one circumferential-contact boss 14 formed axially or radially on each side of the distribution opening 21, the said boss 14 having a circumferential line of contact 15 that can come into contact with the rotor-side low-pressure sealing surface 13.

It will be noted that the circumferential-contact boss 14 and/or the rotor-side low-pressure sealing surface 13 may be nitrided, case-hardened and/or coated with DLC "Diamond-like-Carbon" or have any other coating that is hard and/or has a low coefficient of friction.

The hydraulic pump distributor sealing ring 1 also comprises at least one compression-decompression track 24 formed on a certain angular sector of the rotor-side ring face 22, the said sector being positioned outside of that part of the said face 22 in which the radial distribution opening 21 is situated. The said track 24 is particularly visible in FIG. 5.

As can be seen clearly in FIG. 9, the sealing ring 1 according to the invention further comprises at least one ring sealing lip 39 that may or may not be secured to the continuous sealing ring 11 and that performs axial or radial sealing between the said ring 11 and the ring groove 16.

FIG. 11 in particular shows that the hydraulic pump distributor sealing ring 1 comprises at least one compression-decompression sealing gasket 28 which performs sealing between the stator-side ring face 23 and the bottom and/or the axial or radial sides of the ring groove 16 and does so in the angular area defined by the angular sector over which the compression-decompression track 24 is formed.

Finally, the hydraulic pump distributor sealing ring 1 comprises rotation-proofing means 36, as shown in FIGS. 4 and 5, which keep the continuous sealing ring 11 in a fixed angular position in relation to the pump stator 3.

The hydraulic pump distributor sealing ring 1 according to the invention makes the provision that the ring groove 16 may—as illustrated in FIG. 9—comprise a ring bearing face 17 on its sides which are oriented at right angles to the stator-side low-pressure sealing surface 12, the said bearing face 17 collaborating with a ring bearing shoulder 19 that the continuous sealing ring 11 comprises.

It may be noted, again in FIG. 9, that the ring groove 16 may comprise a ring sealing face 18 on its sides which are oriented at right angles to the stator-side low-pressure sealing surface 12, the said sealing face 18 collaborating with a ring sealing shoulder 20 that the continuous sealing ring 11 comprises.

As FIG. 9 shows, the ring sealing lip 39 may be a flexible metal blade secured to the ring sealing shoulder 20.

It will be noted that the ring sealing lip 39 may be positioned on, under or in the continuation of the ring sealing shoulder 20.

The ring sealing lip 39 may consist of a lateral sealing gasket 27 made of a flexible material kept simultaneously in contact with the ring groove 16 and with the stator-side ring face 23, as FIG. 10 clearly shows. The said flexible material may for example be rubber or an elastomer and may be reinforced with a more rigid material such as plastic, Teflon, steel or any stiffening material or structure known to those skilled in the art.

As FIG. 11 shows, the hydraulic pump distributor sealing ring according to the invention makes the provision that the compression-decompression sealing gasket 28 has at least one sectorial compression-decompression cell cavity 25 which, with the stator-side ring face 23 and the bottom and/or axial or radial sides of the ring groove 16, defines a closed and sealed volume, it being possible for the said cell cavity 25 to have a round, oval, oblong, square, rectangular or any geometry of cross section, with no limitation at all.

The compression-decompression sealing gasket 28 may comprise a stiffening cellular structure 40 in which the sectorial compression-decompression cell cavity 25 is formed, the said cellular structure 40 being produced in a rigid material 42 and being able to be kept in position in relation to the continuous sealing ring 11 directly or indirectly using the rotation-proofing means 36, whereas the said rigid material 42 may be coated completely or partially with a flexible material 43 that can come into contact with the stator-side ring face 23 on the one hand, and/or with the bottom and/or the axial or radial sides of the ring groove 16 on the other hand.

FIGS. 4, 5, 7, 8, 11, 12 and 13 show that the stiffening cellular structure 40 may be incorporated into the stator-side ring face 23 and is made from the same piece of material as the continuous sealing ring 11. In that case, the sectorial compression-decompression cell cavity or cavities 25 may be hollowed into the stator-side ring face 23 for example using electrochemical machining, whereas the lateral sealing gasket 27 and the compression-decompression sealing gasket 28 may notably be made of a flexible material 43 overmolded over the stator-side ring face 23 and the stiffening cellular structure 40, the said gaskets then having the sole role of providing the best possible seal between the continuous sealing ring 11 and the ring groove 16 with which it collaborates.

According to one particular embodiment of the hydraulic pump distributor sealing ring 1 according to the invention shown in FIGS. 5 to 8 and in FIG. 11, the compression-decompression track 24 may have at least one sectorial compression-decompression orifice 26 via which a sectorial compression-decompression duct 41 opens, the latter duct connecting the closed and sealed volume defined by the sectorial compression-decompression cell cavity 25 with the rotor-side ring face 22, the said sectorial orifice 26 being positioned in such a way that the feed orifice 9 finds itself facing the said sectorial orifice 26 once per revolution of the pump rotor 4, the said sectorial orifice 26 then connecting the feed duct 10 to the said sealed volume via the sectorial compression-decompression duct 41.

It will be noted that, in this case, the pressure to which the hydraulic fluid contained in the feed duct 10 is subjected immediately spreads to the closed and sealed volume that the sectorial compression-decompression cell cavity 25 defines. With this in mind, the area of the compression-decompression sectorial cell cavity 25 over which the said pressure is exerted is advantageously made bigger than the cross-sectional area of the feed orifice 9 so that the compression-decompression track 24 naturally finds itself pressed by the said pressure firmly against the rotor-side low-pressure sealing surface 13 that it faces, this result producing the desired sealing between the said track 24 and the said surface 13.

It may be noted—particularly in FIGS. 4 and 5—that the lateral sealing gasket 27 and the compression-decompression sealing gasket 28 may be formed as just one component that may be made up of various rigid and flexible materials so as to be locally resistant to deformation and locally or uniformly reinforced and/or strengthened by any means known to those skilled in the art.

In this respect, as FIGS. 10 and 11 show, the lateral sealing gasket 27 and/or the compression-decompression sealing gasket 28 may for example have a metal core 55 made of a rigid material 42.

It will be noted that the ring sealing face 18 may be positioned approximately plumb with the circumferential line of contact 15 although a small offset between the said face 18 and the said line 15 allows—as FIG. 10 suggests—the pressure prevailing in the ring groove 16 to press the said line 15 firmly against the pump rotor feed face 6 in order to achieve good sealing between the said line 15 and the said feed face 6 while at the same time generating nothing more than a small amount of contact load between these two faces and therefore little by way of friction losses.

FIG. 10 also illustrates that the ring sealing face 18 may be positioned approximately plumb with the circumferential line of contact 15 whereas the ring sealing face 17 may be further away from the bottom of the ring groove 16 and the distribution opening 21 than the said sealing face 18 so that it is offset out of plumb with the circumferential line of contact 15.

According to another particular embodiment of the hydraulic pump distributor sealing ring 1 according to the invention shown in FIG. 4, at least one of the axial faces of the ring groove 16 may be formed by the axial face of a ring mounting band 34 that fits closely around the pump stator 3, the said band 34 allowing the continuous sealing ring 11 and/or the compression-decompression sealing gasket 28 and/or the lateral sealing gasket 27 to be mounted on the pump stator 3.

It will be noted that the said mounting band 34 may be mounted on the pump stator 3 notably by shrink-fitting, bonding, screwing, crimping, rollering or welding and that it may comprise at least one solid or viscous sealing gasket housed between it and the pump stator 3.

It may be noted in FIGS. 3 and 4 that the pump stator distribution face 5 and the pump rotor feed face 6 may be cylindrical whereas at least one of the inlet-delivery ports 7 collaborates with at least one radial-load compensating port 30 formed in the pump stator 3, the latter port 30 opening from the pump stator distribution face 5 and facing the pump rotor feed face 6, the said compensating port 30 also being situated—within the said stator 3—diametrically opposite the inlet-delivery port 7 with which it collaborates and being connected by a radial-load compensating duct 31 to the inlet-delivery duct 8 to which the said inlet-delivery port 7 with which it collaborates is connected.

It will be noted that the surface area that the said compensating port 30 exposes to the pressure is more or less equivalent to the surface area that the inlet-delivery port 7 with which it collaborates exposes to that same pressure such that the said pressure generates little or nothing by way of radial load on the pump stator 3 and on the pump rotor 4. It will also be noted that the compensating port 30 may be formed inside the surface area that the stator-side low-pressure sealing surface 12 delimits whereas it may face the rotor-side low-pressure sealing surface 13.

As illustrated notably by FIGS. 4, 14 and 15, the compensating port 30 may open from the pump stator distribution face 5 via a radial-load compensating groove 29 in which a radial-load compensating sealing plate 32 is housed with a small amount of axial and/or tangential clearance, the said sealing plate 32 being made for example of steel.

FIG. 15 shows that the radial-load compensating sealing plate 32 may have passing right through it in the direction of its thickness a compensating opening 48 which places the radial-load compensating duct 31 in communication with the pump rotor feed face 6.

It will be noted that the compensating opening 48 may consist of a hole of small cross section keeping the radial-load compensating sealing plate 32 as rigid as possible, the sole function of the said hole being to spread to the pump rotor feed face 6 the pressure prevailing in the radial-load compensating duct 31 to which the said plate 32 is connected.

FIG. 14 shows that the radial-load compensating groove 29 may comprise a plate bearing face 49 on its sides which are oriented at right angles to the stator-side low-pressure sealing surface 12, the said bearing face 49 collaborating with a plate bearing shoulder 51 that the radial-load compensating sealing plate 32 comprises.

FIG. 14 also shows that the radial-load compensating groove 29 may comprise a plate sealing face 50 on its sides which are oriented at right angles to the stator-side low-pressure sealing surface 12, the said sealing face 50 collaborating with a plate sealing shoulder 52 that the radial-load compensating sealing plate 32 comprises.

Still in FIG. 14, it may be seen that the radial-load compensating sealing plate 32 may collaborate with a compensating-plate sealing lip 45 that may or may not be secured to the said plate 32, the said lip 45 performing axial and/or radial and/or tangential sealing between the said plate 32 and the radial-load compensating groove 29, whereas the said lip 45 may notably be a flexible metal blade secured to the plate sealing shoulder 52 and/or be positioned on, under or in the continuation of the said shoulder 52.

It will be noted that the ring sealing lip 39 may consist of a flexible compensating sealing gasket 33 made of a flexible material kept simultaneously in contact with the radial-load compensating groove 29 and with the radial-load compensating sealing plate 32, it being possible for example for the said flexible material to be rubber or an elastomer, possibly reinforced with a more rigid material such as plastic, Teflon, steel or any stiffening material or structure known to those skilled in the art.

According to the particular embodiment of the hydraulic pump distributor sealing ring 1 according to the invention shown in FIGS. 14 and 15, the radial-load compensating sealing plate 32 may comprise at least one compensating peripheral contact boss 46 formed at its periphery, the said boss 46 having a compensating peripheral line of contact 47 able to come into contact with the pump rotor feed face 6.

It will be noted that, advantageously, the compensating peripheral contact boss 46 and/or the rotor-side low-pressure sealing surface 13 with which it collaborates may be nitrided, case-hardened and/or coated with DLC "Diamond-like-Carbon" or have any other coating that is hard and/or has a low coefficient of friction.

Also, the plate sealing face 50 may be positioned approximately plumb with the compensating peripheral line of contact 47, although a small offset between the said face 50 and the said line 47 allows the pressure prevailing in the radial-load compensating groove 29 to press the said line 47 firmly against the pump rotor feed face 6 to create a good seal between the said line 47 and the said feed face 6 while at the same time generating only a small amount of contact load between these two faces and therefore little by way of friction losses. This configuration is clearly set out in FIG. 15.

FIG. 15 also shows that the plate sealing face 50 may be positioned approximately plumb with the compensating peripheral line of contact 47 whereas the plate bearing face 49 is further away from the bottom of the radial-load compensating groove 29 and the compensating opening 48 than the said sealing face 50 so that it is offset out of plumb with the compensating peripheral line of contact 47.

As FIGS. 3 to 10 and 12 and 13 show, the distribution opening 21 may comprise at least one connecting beam 56 which connects together the circumferential-contact bosses 14, the said beam 56 thus defining on either side of its length at least one distribution sub-opening 57, the said beam 56 therefore partially closing off the inlet-delivery port 7 which is approximately axially or radially aligned with the said opening 21 without compromising the correct flow of a hydraulic fluid or of any other fluid between the said port 7 and the feed orifice 9 facing it.

It may be noted from FIGS. 4 and 5 that the rotation-proofing means 36 may consist of at least one ring rotation-proofing pin 35 which on the one hand is plugged into a stator rotation-proofing pin hole 37 formed in the pump stator 3 and on the other hand is inserted into a ring rotation-proofing pin hole 38 that passes through the continuous sealing ring 11 in the direction of its thickness.

It will be noted that the ring rotation-proofing pin 35 can be mounted freely in the ring rotation-proofing pin hole 38 and tightly in the stator rotation-proofing pin hole 37 or vice versa, it being possible for example for the said rotation-proofing pin 35 to be a metal cylinder or an elastic split pin.

How the Invention Works:

The way in which the hydraulic pump distributor sealing ring 1 according to the present invention works will be understood from the foregoing description and in conjunction with FIGS. 1 to 15.

Figure 1:
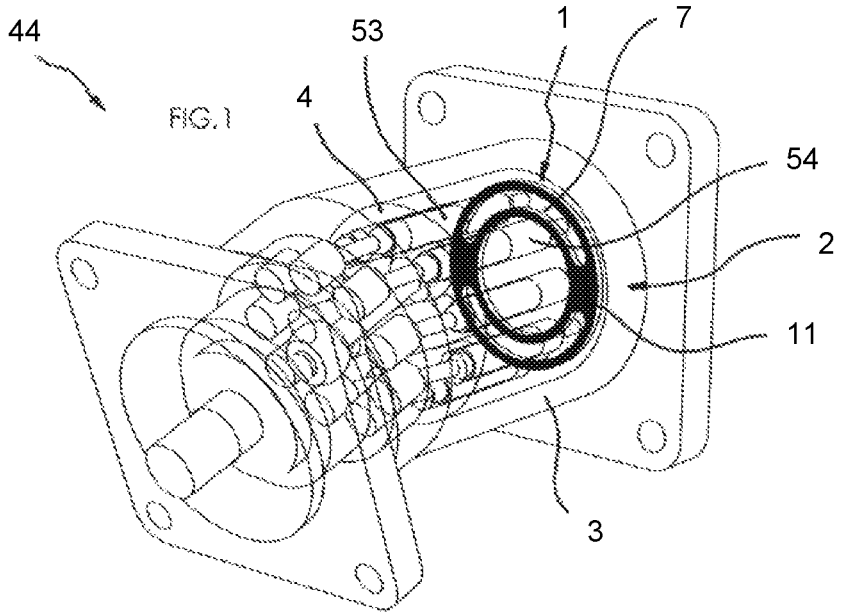
FIG. 1 is a three-dimensional phantom view of an axial-piston hydraulic pump comprising a hydraulic distributor that accepts the hydraulic pump distributor sealing ring according to the invention the continuous sealing ring of which is of planar overall shape and interposed between a pump stator distribution face and a pump rotor feed face likewise of planar shape.
Figure 2:
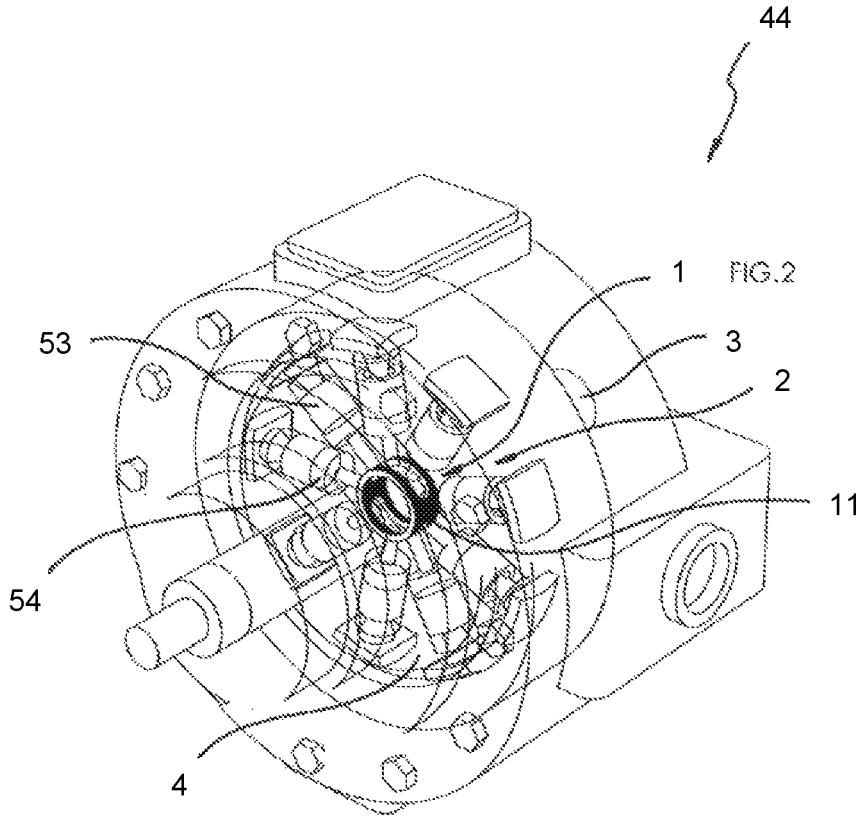
FIG. 2 is a three-dimensional phantom view of a radial-piston hydraulic pump comprising a hydraulic distributor that accepts the hydraulic pump distributor sealing ring according to the invention the continuous sealing ring of which is of cylindrical overall shape and is interposed between a pump stator distribution face and a pump rotor feed face likewise of cylindrical shape.

To illustrate how the said ring 1 works the configuration shown in FIGS. 2 to 15 has mainly been chosen and applied to a hydraulic pump 44 the hydraulic pump pistons 53 and hydraulic pump cylinders 54 of which are organized radially in the pump rotor 4 as shown by FIG. 2. It must be emphasized that, in this nonlimiting exemplary embodiment, the said pump 44 pumps oil.

According to this nonlimiting exemplary embodiment of the sealing ring 1 according to the invention, the pump stator distribution face 5 and the pump rotor feed face 6 are cylindrical. The said ring 1 is therefore also of mainly cylindrical shape. As FIGS. 8, 12 and 13 clearly illustrate, the hydraulic distributor 2 comprises in this example two inlet-delivery ports 7. That justifies the fact that the continuous sealing ring 11 comprises two distribution openings 21 each radially aligned with the inlet-delivery port 7 with which it collaborates, as FIGS. 3 to 8 and 12 and 13 show.

FIG. 10 is a partial section on B-B of the continuous sealing ring 11 shown in FIG. 8. The said section is taken at a distribution opening 21 and, more particularly, at a distribution sub-opening 57. The said section notably shows the circumferential-contact boss 14 formed axially on each side of the said opening 21. As FIG. 9 shows in three dimensions, the said boss 14 has a circumferential line of contact 15 designed to come into contact with the rotor-side low-pressure sealing surface 13 in order to create the best possible seal therewith.

It can be seen in FIGS. 3 to 10 and 12 and 13 that the distribution openings 21 pass right through the continuous sealing ring 11 in the direction of its thickness and are separated from one another in the circumferential direction by a compression-decompression track 24 to the surface of which several sectorial compression-decompression ducts 41 open each via its own sectorial compression-decompression orifice 26. In this nonlimiting embodiment, the circumferential-contact bosses 14 formed axially on each side of the distribution openings 21 are connected in the axial direction by connecting beams 56 which separate the distribution sub-openings 57.

It may be noted, particularly in FIGS. 8, 12 and 13, that each sectorial compression-decompression duct 41 is connected to a sectorial compression-decompression cell cavity 25 which, with the bottom of the ring groove 16, defines a closed and sealed volume. FIG. 11 is a partial section on C-C of the continuous sealing ring 11 shown in FIG. 8, showing in detail how a sectorial compression-decompression cell cavity 25 is arranged and how it is connected to the surface of the compression-decompression track 24 by the sectorial compression-decompression duct 41 with which it collaborates.

It can be clearly seen in FIGS. 5, 7, 8, 12 and 13 that the sectorial compression-decompression cell cavities 25 are formed in a cellular stiffening structure 40 incorporated into the stator-side ring face 23, the said structure 40 forming, with a flexible material 43 overmolded over the said structure, the compression-decompression sealing gasket 28 as shown in greater detail in FIG. 11.

FIGS. 4 and 5 incidentally show that, according to the particular embodiment of the sealing ring 1 according to the invention considered here in order to illustrate how it works, the two compression-decompression sealing gaskets 28 and the four lateral sealing gaskets 27 notably consist of one and the same continuous piece of flexible material 43. For greater clarity, in the said figures, the said continuous piece is shown separate from the continuous sealing ring 11. In practice, the said piece may cover the stator-side ring face 23 and the stiffening cellular structure 40 incorporated into the said ring face 23 by being overmolded or bonded thereto.

FIG. 11 shows that the flexible material 43 partially fills the sectorial compression-decompression cell cavities 25 so as to form a pocket in the said cell cavities 25, and creates the best possible seal between the stator-side ring face 23 and the ring groove 16.

As can be seen from FIGS. 4 and 5, the continuous sealing ring 11 is kept in a fixed angular position in relation to the pump stator 3 by the ring rotation-proofing pin 35—in this instance a simple metal cylinder—which passes through the said ring 11 via the ring rotation-proofing pin hole 38, the said pin 35 being free in the said hole 38 whereas it is blocked in the stator rotation-proofing pin hole 37.

It will be readily deduced from FIG. 4 that the continuous sealing ring 11 thus configured with its compression-decompression sealing gaskets 28 and its lateral sealing gaskets 27 has been able to be mounted on the pump stator 3 by virtue of the ring mounting band 34.

It may also be noted from FIGS. 3 and 4 that the pump stator 3 has four radial-load compensating ports 30 positioned angularly on each side of the inlet-delivery ports 7. With this particular configuration of the hydraulic pump distributor sealing ring 1 according to the invention, each inlet-delivery port 7 collaborates with the two radial-load compensating ports 30 which are formed diametrically opposite them in the pump stator 3, the latter ports 30 being connected by their radial-load compensating duct 31 to the same inlet-delivery duct 8 as the inlet-delivery port 7 with which they collaborate, as is clearly shown in FIG. 3.

It will be noted that the total surface area that the two said compensating ports 30 expose to the pressure is substantially equivalent to the surface area exposed to the same pressure by the inlet-delivery port 7 with which they collaborate. Thus, the pressure prevailing in the inlet-delivery port 7 generates a radial load on the pump stator 3 and on the pump rotor 4 that is low, or even zero.

It may be seen that, in the manner of the continuous sealing ring 11 which provides the best possible seal between the inlet-delivery ports 7 and the pump rotor feed face 6, the radial-load compensating sealing plate 32 that each radial-load compensating port 30 possesses also provides the best possible seal between the said port 30 and the said feed face 6.

In this respect, the radial-load compensating sealing plate 32 notably comprises a compensating-plate sealing lip 45 which provides sealing between the said plate 32 and the radial-load compensating groove 29 with which it collaborates. FIG. 14, which is a three-dimensional cross section through the said plate 32, and FIG. 15 which is a schematic cross section thereof, show that, in the scenario considered here in order to illustrate how the sealing ring 1 according to the invention works, the compensating-plate sealing lip 45 is a thin metal strip formed in the continuation of the plate sealing shoulder 52 and which collaborates with a flexible compensating sealing gasket 33 made of flexible material 43 such as rubber or an elastomer, the said flexible material 43 potentially being overmolded under the radial-load compensating sealing plate 32 and in the continuation of the said shoulder 52, the said flexible gasket 33 being kept simultaneously in contact with the radial-load compensating groove 29 and with the lower part of the compensating-plate sealing lip 45.

It may be emphasized here that the radial-load compensating sealing plate 32 is relatively flexible and readily deformable so that the pressure can press the compensating peripheral line of contact 47 thereof against the rotor-side low-pressure sealing surface 13.

In order to do so, the plate sealing face 50 that the radial-load compensating groove 29 exhibits is designed to be out of plumb with the compensating peripheral line of contact 47 that the radial-load compensating sealing plate 32 comprises immediately above the said sealing face 50. This offset means that the cross-sectional area S1 over which the pressure is exerted is small so that the radial load resulting from the said cross-sectional area S1 remains small. This tends to achieve good sealing between the compensating peripheral line of contact 47 and the rotor-side low-pressure sealing surface 13 while at the same time generating little contact load at the contact between the said line 47 and the said surface 13 and therefore little by way of friction losses.

In order to describe how the sealing ring 1 according to the invention works in an appropriate manner it should be emphasized that the continuous sealing ring 11 is of small thickness and that, as a result, it is also relatively flexible and readily deformable. Moreover, it should also be emphasized that the ring groove 16 is deep enough for the said continuous ring 11 to be able to sit radially eccentrically in relation to the said groove 16 as FIGS. 12 and 13 show. However, it must be appreciated that in practice, the deformations and eccentricities to which the continuous sealing ring 11 is subjected are of the order of a few microns to a few tens of microns and that FIGS. 12 and 13 which depict the said deformations and eccentricities greatly exaggerate same so that the impact these have on the operation of the sealing ring 1 according to the invention can be understood.

Thus, when the radial-piston hydraulic pump 44, of the type depicted in FIG. 2, is in operation, its pump rotor 4 rotates about the pump stator 3. The pump stator distribution face 5 is positioned facing the pump rotor feed face 6 whereas the inlet-delivery ports 7 are approximately aligned with the nine feed orifices orifice 9 each of which feeds a hydraulic pump cylinder 54 via its own feed duct 10.

It may be noted from FIGS. 12 and 13 that the pressure prevailing in the inlet-outlet port 7 situated highest up and which we shall temporarily refer to as the "upper port 7" does not spread to the inlet-delivery port 7 positioned furthest down in the said FIGS. 12 and 13 and which we will temporarily refer to as the "lower port 7", this being because of the continuous sealing ring 11 and notably because of the compression-decompression sealing gasket 28 which prevents the oil from passing tangentially between the stator-side ring face 23 and the bottom of the ring groove 16.

If, as FIG. 12 illustrates, it is the upper port 7 that has the highest prevailing pressure—for example 1000 bar—while the pressure prevailing in the lower port 7 is lower—for example 10 bar—the said higher pressure applies a local radial thrust to the stator-side ring face 23 the magnitude of the thrust being greater than the thrust that the lower pressure prevailing in the lower port 7 applies to the said face 23.

The result of this thrust imbalance is that the continuous sealing ring 11 deforms and becomes pressed firmly against the rotor-side low-pressure sealing surface 13 in the region of the upper port 7 whereas the said continuous ring 11 remains a distance of a few microns or tens of microns away from the said surface 13 in the region of the lower port 7.

It will be noted that the load corresponding to the said radial thrust remains small because the pressure is exerted on the stator-side ring face 23 over only a small cross-sectional area S1 of the said face 23 as shown in FIG. 10. The said cross-sectional area S1 was determined at the design phase of the continuous sealing ring 11 and is a result of the deliberate axial offset created between the two ring sealing faces 18 that the ring groove 16 has to offer on either side of the continuous sealing ring 11 and line plumb with the circumferential line of contact 15 that is formed immediately above each of the said sealing faces 18 on the rotor-side ring face 22. In this respect it will be noted that, as FIG. 10 shows well, the circumferential lines of contact 15 are located axially further towards the inside of the continuous sealing ring 11 than the ring sealing faces 18 with which they collaborate so as to produce the desired local radial thrust on the stator side ring face 23.

Thus, the axial offset provided between the two ring sealing faces 18 and line plumb with the circumferential lines of contact 15 and which determines the cross-sectional area S1 means that the pressure prevailing in the ring groove 16 effectively presses the said lines 15 firmly against the pump rotor feed face 6. This tends to create sealing between the said lines 15 and the said feed face 6 while at the same generating little by way of contact load at the contact between the said lines 15 and the said face 6 and therefore little by way of friction losses. It will be noted that the contact pressure at the contact between the said lines 15 and the pump rotor feed face 6 is essentially dependent on the width of the contact made by the said lines 15 with the said face 6, the said width also being dependent on a deliberate choice made in the design of the continuous sealing ring 11.

It can be seen from FIG. 10 that sealing between the ring sealing face 18 exhibited by the ring groove 16 and the ring sealing shoulder 20 exhibited by the continuous sealing ring 11 is achieved, on the one hand, by the ring sealing lip 39 which remains in contact—on account of its elasticity—with the ring sealing face 18 and, on the other hand, by the lateral sealing gasket 27. Thus, the said lip 39 prevents the said seal 27 from becoming extruded, even under very high pressure—for example 2000 bar—whereas the said gasket provides perfect sealing.

It was seen in FIG. 12 that, because of the deformation of the continuous sealing ring 11 in the region of the lower port 7, the rotor-side ring face 22 remained a distance of a few microns or tens of microns away from the rotor-side low-pressure sealing surface 13. In the angular sector occupied by the said lower port 7 the circumferential lines of contact 15 therefore do not press the pump rotor feed face 6 firmly and therefore do not provide any sealing.

In consequence, sealing between the said lower port 7 and the pump rotor feed face 6 is achieved only through the small clearance of a few microns or tens of microns left between the stator-side low-pressure sealing surface 12 and the rotor-side low-pressure sealing surface 13. The said small clearance is obtained notably through high-precision machining of the said surfaces 12, 13 whereas the leakage flows passing between the latter remain small because of the low pressure—here 10 bar according to the example chosen—prevailing in the lower port 7. The energy loss associated with the said leakage flows is therefore negligible.

It will be appreciated that FIG. 13 shows the deformation of the continuous sealing ring 11 when it is the upper port 7 that has the lower prevailing pressure, for example 10 bar, whereas it is the lower port 7 that has the higher prevailing pressure, for example 1000 bar, the way in which the continuous sealing ring 11 works remaining unchanged.

The sectorial compression-decompression cell cavities 25 which provide good sealing between the feed orifices 9 and the compression-decompression track 24 after the said orifices 9 have left the angular sector occupied by the upper port 7 have been noted, particularly in FIGS. 8, 12 and 13. The said cell cavities 25 are also visible in three dimensions in FIG. 5, and in schematic cross section in FIG. 11.

Indeed, according to the example considered here for illustrating how the sealing ring 1 according to the invention works, the hydraulic pump cylinders 54 draw in oil at 10 bar from the lower port 7 and deliver it at 1000 bar at the upper port 7. Thus, as any feed orifice 9 makes the transition from the upper port 7 to the lower port 7 via the compression-decompression track 24 the oil contained in the hydraulic pump cylinder 54 and in the feed duct 10 which are connected to the said feed orifice 9 needs to be progressively depressurized (expanded).

During this expansion, energy stored by the said oil as it was being compressed—the said oil being compressible—can be recovered mechanically by the hydraulic pump 44. This function is necessary for conferring good energy efficiency upon the said pump 44.

When—because of the rotating of the pump rotor 4—the feed orifice 9 leaves the upper port 7 to begin to follow the compression-decompression track 24, the said orifice 9 which hitherto had been placing the said upper port 7 in communication with the corresponding hydraulic pump cylinder 54 via its own feed duct 10 finds itself closed off by the said track 24. As the mechanism of the hydraulic pump 44 increases the volume of the hydraulic pump cylinder 54, the oil contained therein expands and begins to yield to the said pump 44 in mechanical form the energy that was stored during the compression of the said oil.

The feed orifice 9 continues to start out along the compression-decompression track 24 until it comes across a first sectorial compression-decompression orifice 26 which connects the said track 24 to the closed and sealed volume that the sectorial compression-decompression cell cavity 25 situated immediately below the said sectorial orifice 26 defines.

This therefore is a return to the configuration illustrated in FIG. 11 and this has the immediate effect of spreading the pressure prevailing in the hydraulic pump cylinder 54 to the said closed and sealed volume the radial cross section of which is significantly greater than that of the feed orifice 9. The differential radial cross-sectional area S2 that results therefrom is depicted in FIG. 11. It will be noted that S2 has been determined during the design phase of the continuous sealing ring 11 on the basis of a compromise between sealing and friction losses.

Because of the differential radial cross-sectional area S2, the compression-decompression track 24 finds itself pressed firmly by the pressure against the rotor-side low-pressure sealing surface 13 onto which the feed orifice 9 opens. This constitutes sealing around the feed orifice 9 between the compression-decompression track 24 and the rotor-side low-pressure sealing surface 13, the load pressing the said track 24 firmly against the said surface 13 being higher the higher the pressure prevailing in the hydraulic pump cylinder 54.

Hence, it will be appreciated that as the feed orifice 9 gradually progresses along the compression-decompression track 24, the volume of the hydraulic pump cylinder 54 increases without the amount of oil that the said cylinder 54 contains increasing. This is dictated by the mechanism of the hydraulic pump 44. The result then is indeed an expansion of the said oil and a recovery of energy that had previously been stored during the compression thereof.

When the said feed orifice 9 comes to the next sectorial compression-decompression orifice 26, the same principle of the compression-decompression track 24 being pressed firmly against the rotor-side low-pressure sealing surface 13 takes place, but at a lower pressure, and so on until the said feed orifice 9 reaches the lower port 7.

It will be noted that, according to the nonlimiting embodiment of the sealing ring 1 according to the invention illustrated in FIGS. 8, 12 and 13, the angular offset between two sectorial compression-decompression orifices 26 and the diameter of the said orifices is calculated in such a way that one and the same feed orifice 9 cannot simultaneously lie facing two said sectorial orifices 26. In order to increase the number of sectorial compression-decompression orifices 26 and, therefore, increase the number of sectorial compression-decompression orifice 26 it will be noted that it is possible to provide feed orifices 9 that are oblong in the axial direction, that can be separated in a staggered configuration over at least two rows, the latter configuration potentially also being applied, by way of nonlimiting example, to the sectorial compression-decompression orifices 26.

Moreover, the geometry of the sectorial compression-decompression cell cavities 25 shown notably in FIG. 5 is nonlimiting and may differ from one cell cavity 25 to another. In practice, the choice of the said geometry needs to be informed by the need, on the one hand, to produce the best possible seal between the compression-decompression track 24 and the rotor-side low-pressure sealing surface 13 and, on the other hand, to generate the smallest possible amounts of friction between the said track 24 and the said surface 13.

The cross-sectional area S1 resulting from the axial offsetting of the ring sealing faces 18 out of plumb with the circumferential lines of contact 15 can be seen in FIG. 11, the said offset being provided in the angular zone of the continuous sealing ring 11 that the compression-decompression track 24 occupies just as it is provided on the rest of the circumference of the continuous sealing ring 11. The said cross-sectional area S1 allows the sealing at the axial margins of the said track 24 to be improved.

It must be appreciated that the foregoing description has been given solely by way of example and that it does not in any way limit the field of the invention which is not overstepped if the embodiment details described are replaced by any other equivalent details.

The invention claimed is:

1. A sealing ring for a hydraulic pump distributor, comprising:

at least one continuous sealing ring housed with a small amount of axial and/or radial clearance in a ring groove formed in a pump stator inside a surface area delimited by a stator-side low-pressure sealing surface, said at least one continuous sealing ring having a stator-side ring face housed inside a ring groove, and a rotor-side ring face flush with the stator-side low-pressure sealing surface, and two inlet-delivery ports open onto said sealing surface via said ring groove, said at least one continuous sealing ring being axially or radially wider than said inlet delivery ports so as to cover said inlet delivery ports and comprising, approximately in axial or radial alignment therewith, at least one distribution opening passing right through the at least one continuous sealing ring in a direction of its thickness direction, said at least one distribution opening being able to place one of the two inlet-delivery ports in communication with a feed orifice when the feed orifice is approximately facing said one of the two inlet-delivery ports;

at least one circumferential-contact boss formed axially or radially on each side of the at least one distribution opening, said boss having a circumferential line of contact that can come into contact with a rotor-side low-pressure sealing surface;

at least one compression-decompression track formed on an angular sector of the rotor-side ring face, said angular sector being positioned outside of a part of said rotor-side ring face in which the at least one distribution opening is situated;

at least one ring sealing lip that may or may not be secured to the at least one continuous sealing ring and that performs axial or radial sealing between said at least one continuous sealing ring and the ring groove;

at least one compression-decompression sealing gasket which performs sealing between the stator-side ring face and bottom and/or the axial or radial sides of the ring groove and does so in an angular area defined by an angular sector over which a compression-decompression track is formed; and rotation-proofing means which keep the at least one continuous sealing ring in a fixed angular position in relation to the pump stator.

2. The sealing ring for a hydraulic pump distributor according to claim 1, wherein the ring groove comprises a ring bearing face on the sides of the ring groove which are oriented at right angles to the stator-side low-pressure sealing surface, said ring bearing face collaborating with a ring bearing shoulder that the at least one continuous sealing ring comprises.

3. The sealing ring for a hydraulic pump distributor according to claim 1, wherein the ring groove comprises a ring sealing face sides of the ring groove which are oriented at right angles to the stator-side low-pressure sealing surface, said ring sealing face collaborating with a ring sealing shoulder that the at least one continuous sealing ring comprises.

4. The sealing ring for a hydraulic pump distributor according to claim 3, wherein the at least one ring sealing lip is a flexible metal blade secured to the ring sealing shoulder.

5. The sealing ring for a hydraulic pump distributor according to claim 3, wherein the at least one ring sealing lip is positioned on, under or in the continuation of the ring sealing shoulder.

6. The sealing ring for a hydraulic pump distributor according to claim 1, wherein the at least one ring sealing lip comprises a lateral sealing gasket made of a flexible material kept simultaneously in contact with the ring groove and with the stator side ring face.

7. The sealing ring for a hydraulic pump distributor according to claim 1, wherein the at least one compression-decompression sealing gasket has at least one sectorial compression-decompression cell cavity which, with the stator side ring face and bottom and/or axial or radial sides of the ring groove, defines a closed and sealed volume.

8. The sealing ring for a hydraulic pump distributor according to claim 7, wherein the at least one compression-decompression sealing gasket comprises a stiffening cellular structure in which a sectorial compression-decompression cell cavity is formed, said cellular structure being produced in a rigid material and being able to be kept in position in relation to the at least one continuous sealing ring directly or indirectly using the rotation-proofing means, whereas said rigid material may be coated completely or partially with a flexible material that can come into contact with the stator-side ring face, and/or with the bottom and/or the axial or radial sides of the ring groove.

9. The sealing ring for a hydraulic pump distributor according to claim 8, wherein the stiffening cellular structure is incorporated into the stator-side ring face and is made from the same piece of material as the at least one continuous sealing ring.

10. The sealing ring for a hydraulic pump distributor according to claim 7, wherein the compression-decompression track has at least one sectorial compression-decompression orifice via which a sectorial compression-decompression duct opens, the sectorial compression-decompression duct connecting the closed and sealed volume defined by the sectorial compression-decompression cell cavity with the rotor-side ring face, said at least one sectorial orifice being positioned in such a way that the feed orifice finds itself facing said at least one sectorial orifice once per revolution of a pump rotor, said at least one sectorial orifice then connecting a feed duct to said sealed volume via the sectorial compression-decompression duct.

11. The sealing ring for a hydraulic pump distributor according to claim 6, wherein the lateral sealing gasket and the at least one compression-decompression sealing gasket form one single component.

12. The sealing ring for a hydraulic pump distributor according to claim 3, wherein the ring sealing face is positioned approximately plumb with a circumferential line of contact.

13. The sealing ring for a hydraulic pump distributor according to claim 3, wherein the ring groove comprises a ring bearing face on sides of the ring groove which are oriented at right angles to the stator-side low-pressure sealing surface, the bearing face collaborating with a ring bearing shoulder that the at least one continuous sealing ring comprises, and the ring sealing face is positioned approximately plumb with the circumferential line of contact whereas the ring bearing face is further away from the bottom of the ring groove and the distribution opening than said sealing face so that it is offset out of plumb with the circumferential line of contact.

14. The sealing ring for a hydraulic pump distributor according to claim 1, wherein at least one of axial faces of the ring groove is formed by the axial face of a ring mounting band that fits closely around the pump stator.

15. The sealing ring for a hydraulic pump distributor according to claim 1, wherein at least one pump stator distribution face and at least one pump rotor feed face are cylindrical whereas at least one of the inlet-delivery ports collaborates with at least one radial-load compensating port formed in the pump stator, the at least one radial-load compensating port opening from at least one pump stator distribution face and facing the at least one pump rotor feed face, said at least one radial-load compensating port also being situated—within said pump stator—diametrically opposite the inlet-delivery ports with which said pump stator collaborates and being connected by a radial-load compensating duct to at least one inlet-delivery duct to which said inlet-delivery ports with which the at least one inlet-delivery duct collaborates is connected.

16. The sealing ring for a hydraulic pump distributor according to claim 15, wherein the at least one radial-load compensating port opens from the at least one pump stator distribution face via a radial-load compensating groove in which a radial-load compensating sealing plate is housed with a small amount of axial and/or tangential clearance.

17. The sealing ring for a hydraulic pump distributor according to claim 16, wherein the radial-load compensating sealing plate has passing right through in a thickness direction of a compensating opening which places the radial-load compensating duct in communication with the at least one pump rotor feed face.

18. The sealing ring for a hydraulic pump distributor according to claim 16, wherein the radial load compensating groove comprises a plate bearing face on sides of the plate bearing face which are oriented at right angles to the stator-side low-pressure sealing surface, said bearing face collaborating with a plate bearing shoulder that the radial-load compensating sealing plate comprises.

19. The sealing ring for a hydraulic pump distributor according to claim 16, wherein the radial load compensating groove comprises a plate sealing face on sides of the radial-load compensating groove which are oriented at right angles to the stator-side low-pressure sealing surface, said sealing face collaborating with a plate sealing shoulder that the radial-load compensating sealing plate comprises.

20. The sealing ring for a hydraulic pump distributor according to claim 16, wherein the radial-load compensating sealing plate collaborates with a compensating-plate sealing lip that may or may not be secured to said radial-load compensating sealing plate, said lip performing axial and/or radial and/or tangential sealing between said radial-load compensating sealing plate and the radial-load compensating groove.

21. The sealing ring for a hydraulic pump distributor according to claim 20, wherein the at least one ring sealing lip comprises a flexible compensating sealing gasket made of a flexible material kept simultaneously in contact with the radial-load compensating groove and with the radial-load compensating sealing plate.

22. The sealing ring for a hydraulic pump distributor according to claim 17, wherein the radial-load compensating sealing plate comprises at least one compensating peripheral contact boss formed at its periphery, said at least one compensating peripheral contact boss having a compensating peripheral line of contact able to come into contact with the at least one pump rotor feed face.

23. The sealing ring for a hydraulic pump distributor according to claim 22, wherein the radial-load compensating groove comprises a plate sealing face on sides of the radial-load compensating groove which are oriented at right angles to the stator-side low-pressure sealing surface, the plate sealing face collaborating with a plate sealing shoulder that the radial-load compensating sealing plate comprises, and the plate sealing face is positioned approximately plumb with the compensating peripheral line of contact.

24. The sealing ring for a hydraulic pump distributor according to claim 23, wherein the radial-load compensating groove comprises a plate bearing face on sides of the radial-load compensating groove which are oriented at right angles to the stator-side low-pressure sealing surface, the plate bearing face collaborating with a plate bearing shoulder that the radial-load compensating sealing plate comprises, the plate sealing face being positioned approximately plumb with the compensating peripheral line of contact whereas the plate bearing face is further away from the bottom of the radial-load compensating groove and the compensating opening than said plate sealing face so that the plate bearing face is offset out of plumb with the compensating peripheral line of contact.

25. The sealing ring for a hydraulic pump distributor according to claim 1, wherein the at least one distribution opening comprises at least one connecting beam which connects together the circumferential-contact bosses, said at least one connecting beam thus defining on either side of the at least one connecting beam's length at least one distribution sub-opening.

26. The sealing ring for a hydraulic pump distributor according to claim 1, wherein the rotation-proofing means comprises at least one ring rotation-proofing pin which is plugged into a stator rotation-proofing pin hole formed in the pump stator and is inserted into a ring rotation-proofing pin hole that passes through the at least one continuous sealing ring in at thickness direction.

* * * * *